United States Patent [19]

Atwell

[11] Patent Number: 4,743,131

[45] Date of Patent: May 10, 1988

[54] TRACTOR FEED CONTINUOUS PAPER SYSTEM FOR PRINTERS

[76] Inventor: J. Dwayne Atwell, 114 W. Erie Dr., Tempe, Ariz. 85282

[21] Appl. No.: 893,708

[22] Filed: Aug. 6, 1986

[51] Int. Cl.[4] ..... B41J 11/58; B41J 15/04

[52] U.S. Cl. ..... 400/613.2; 400/615

[58] Field of Search ..... 400/613–613.4, 400/615, 625, 624

[56] References Cited

U.S. PATENT DOCUMENTS

| | | | |
|---|---|---|---|
| 1,939,202 | 12/1933 | Caton | 400/613.4 X |
| 2,014,939 | 9/1935 | Lake | 400/613.2 |
| 2,319,273 | 5/1943 | Sterling | 400/613.2 X |
| 2,548,715 | 4/1951 | Fitzgerald | 400/613.4 |
| 4,076,160 | 2/1978 | Azzalin | 400/613.2 X |
| 4,089,402 | 5/1978 | Hyland | 400/625 |
| 4,541,749 | 9/1985 | McCoy | 400/613.2 |

FOREIGN PATENT DOCUMENTS

| | | | |
|---|---|---|---|
| 11072 | 1/1982 | Japan | 400/613.2 |
| 1326722 | 8/1973 | United Kingdom | 400/613.4 |

OTHER PUBLICATIONS

R & R Direct Catalog, Fall, 1986, p. 17, "Printer and Computer Accessories", Reynolds and Reynolds Company.

*IBM Tech. Disc. Bulletin,* by J. K. Klitz, vol. 18, No. 4, Sep. 1975, p. 1014.

*IBM Tech. Disc. Bulletin,* by J. H. Neer, vol. 23, No. 11, Apr. 1981, p. 5260.

*Primary Examiner*—Paul T. Sewell

*Attorney, Agent, or Firm*—Don J. Flickinger; Jordan M. Meschkow

[57] ABSTRACT

A continuous paper feed system is designed for use in conjunction with a variety of tractor feed paper feed paper printers. The system comprises a blank paper storage portion which is capable of being secured to a rear portion of the surface which supports the printer. This blank paper storage portion resides generally below the support surface. A printed paper receiving portion rests on the printer for receiving printed paper and is angularly adjustable with respect to the plane of the surface upon which the printer is resting so as to accommodate situations where the printer is tilted forward.

15 Claims, 6 Drawing Sheets

FIG. 1
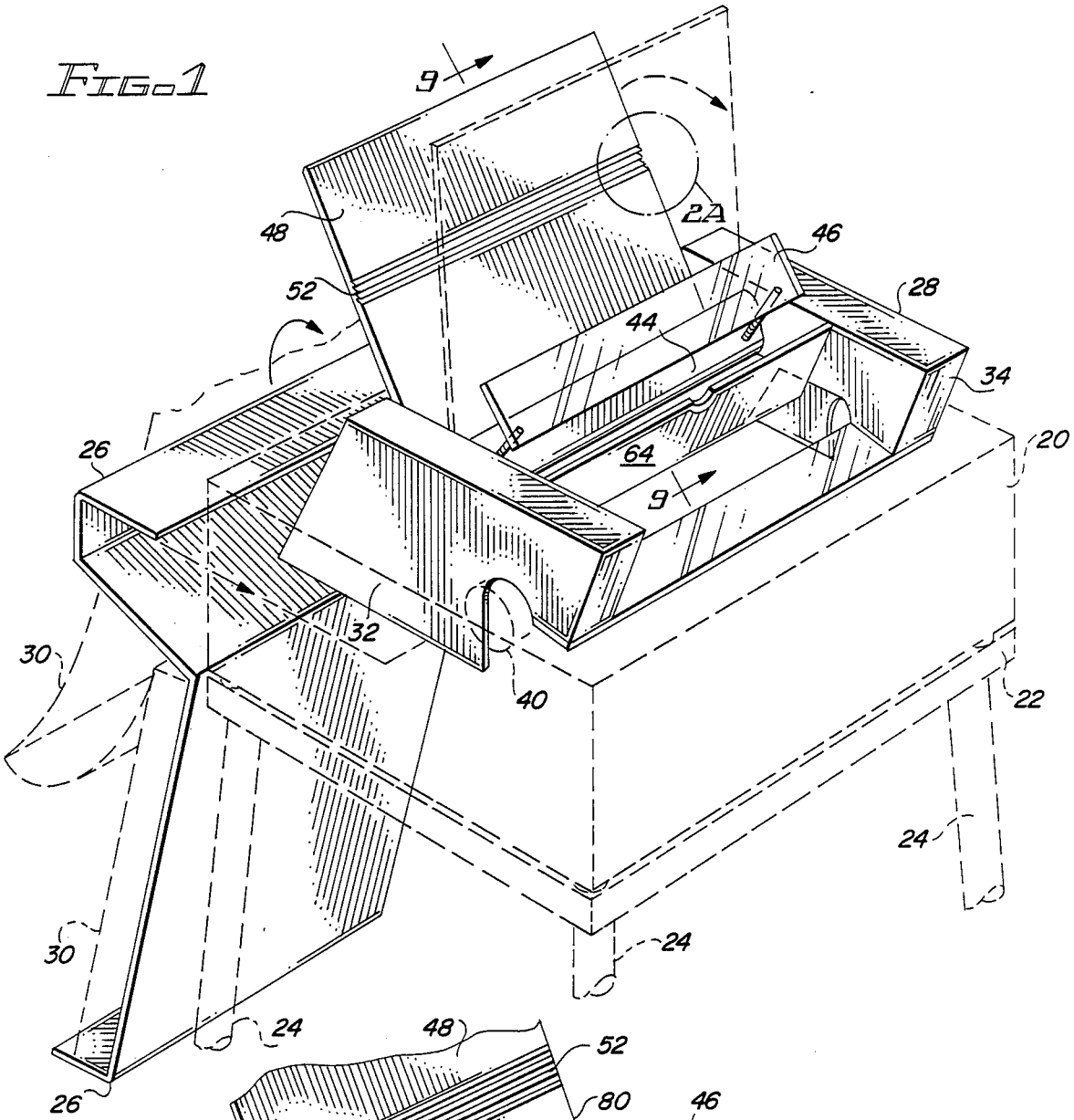
FIG. 2A
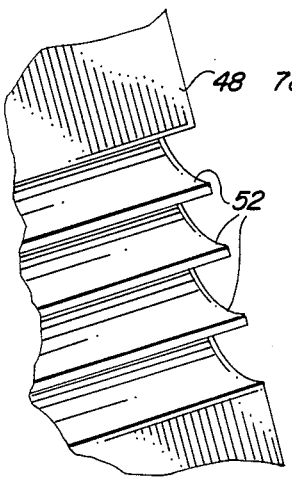
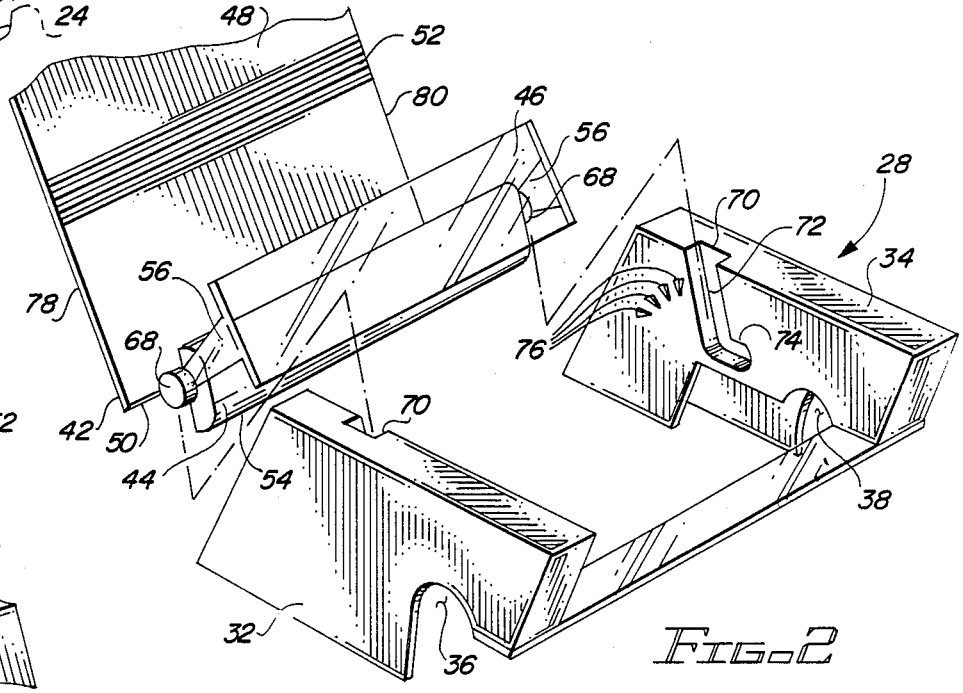
FIG. 2

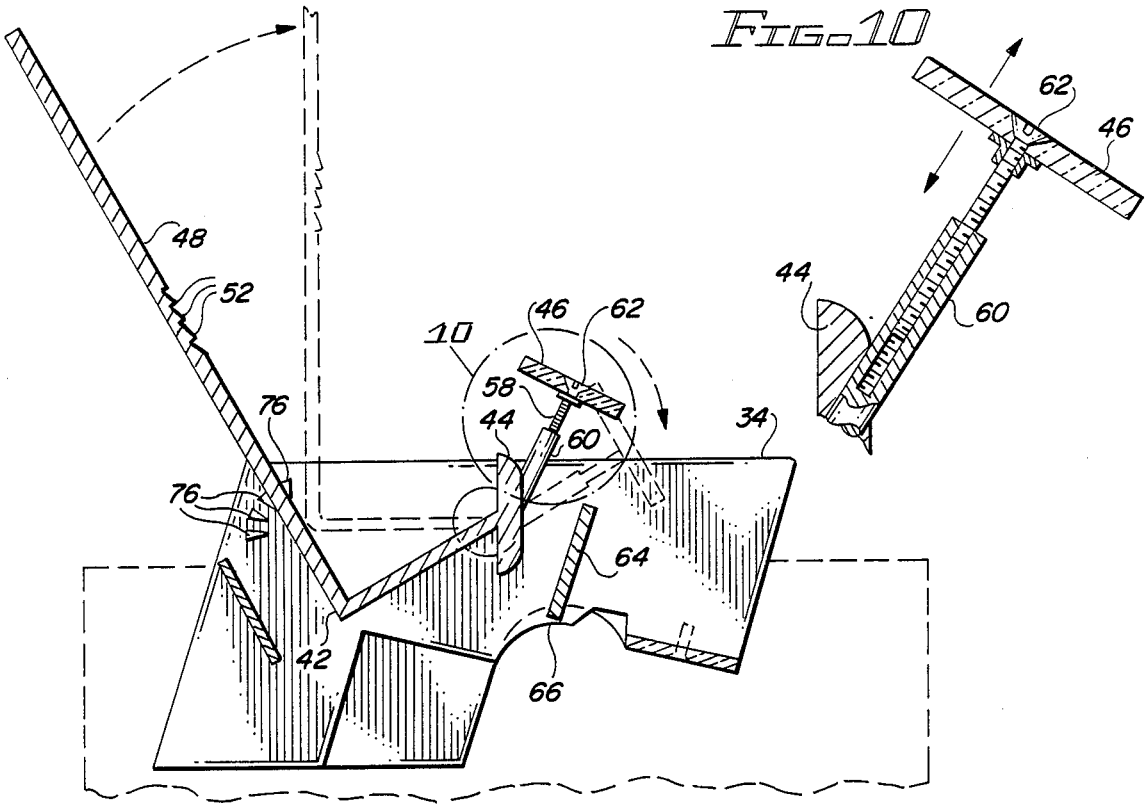
FIG. 10
FIG. 9
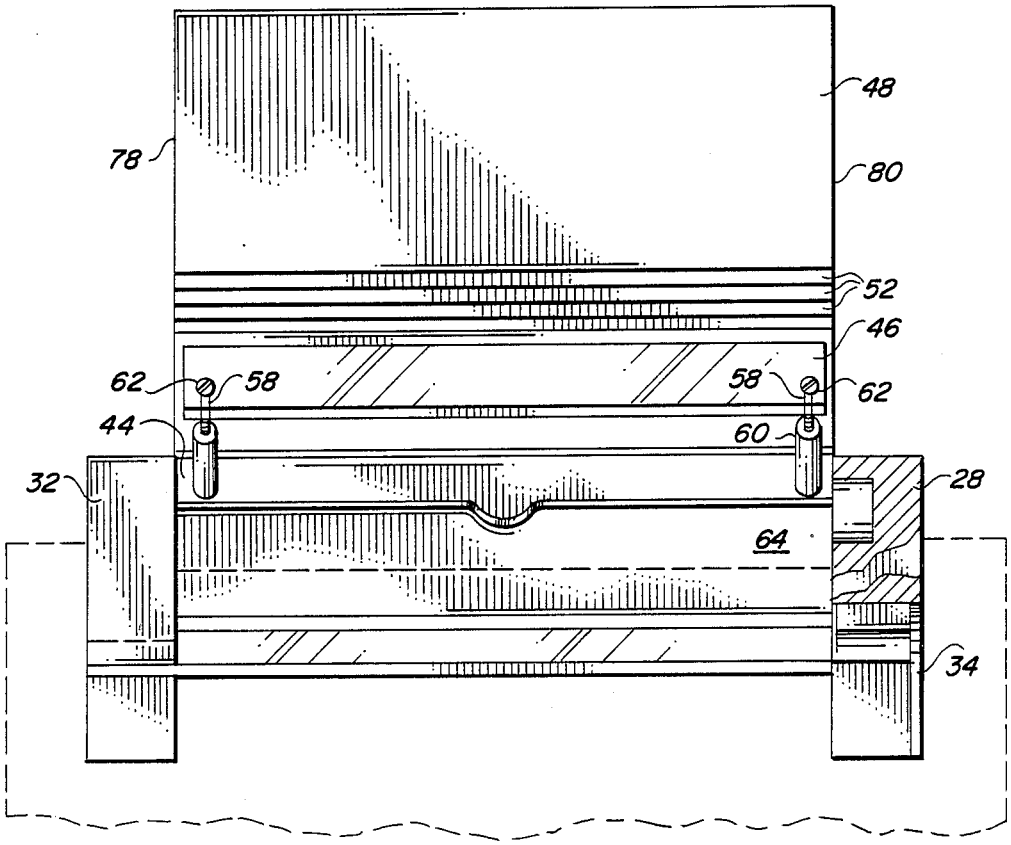
FIG. 11

FIG. 12E
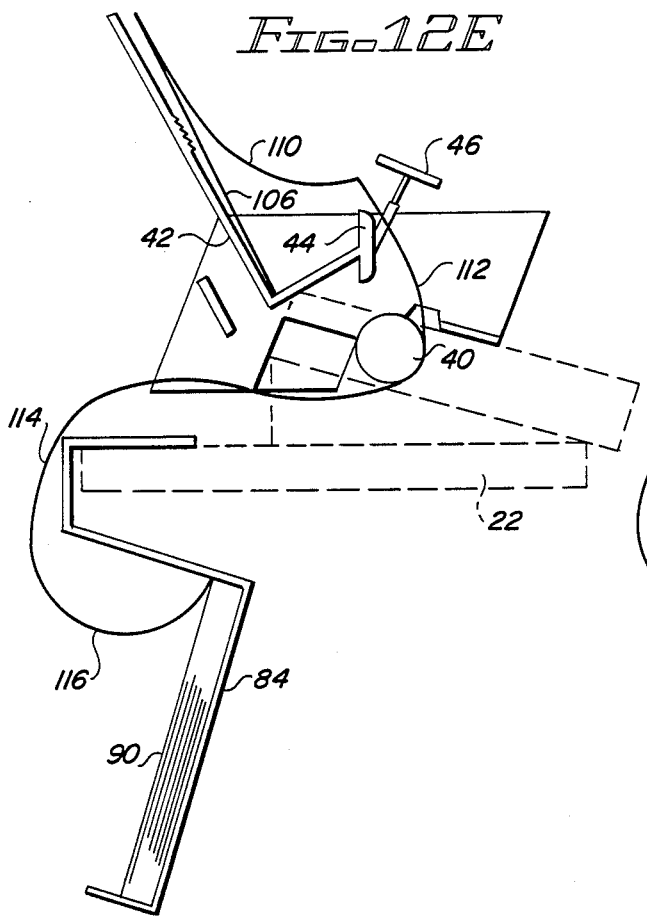
FIG. 12F
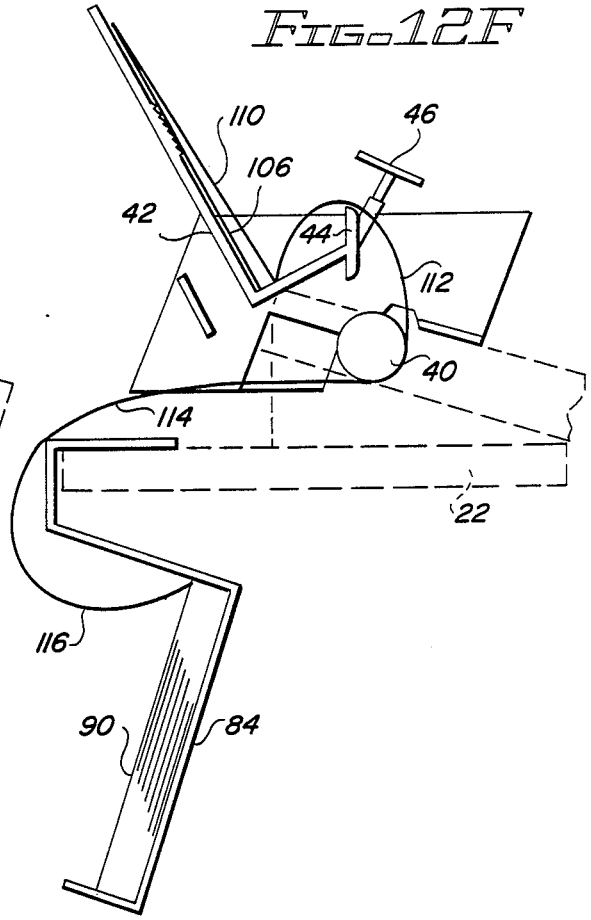
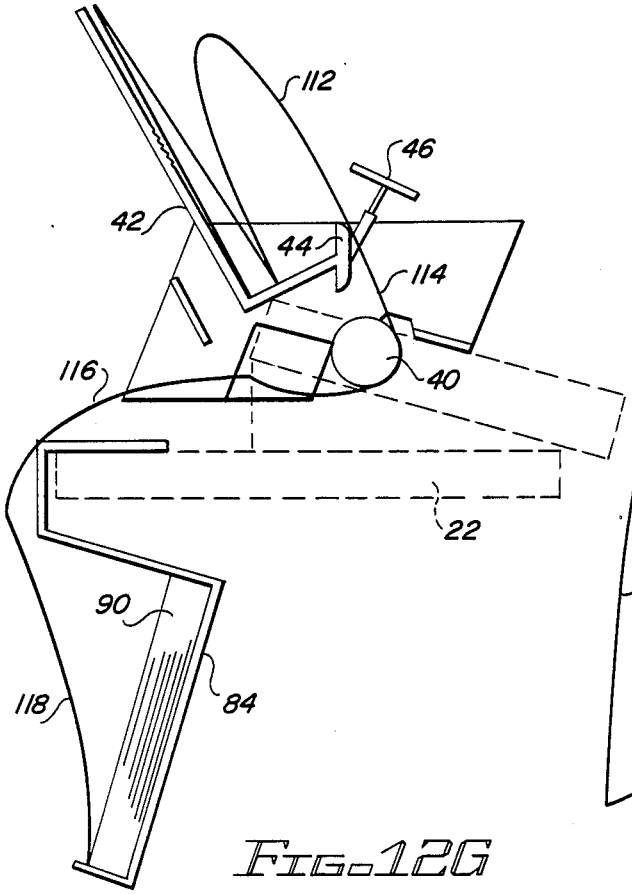
FIG. 12G
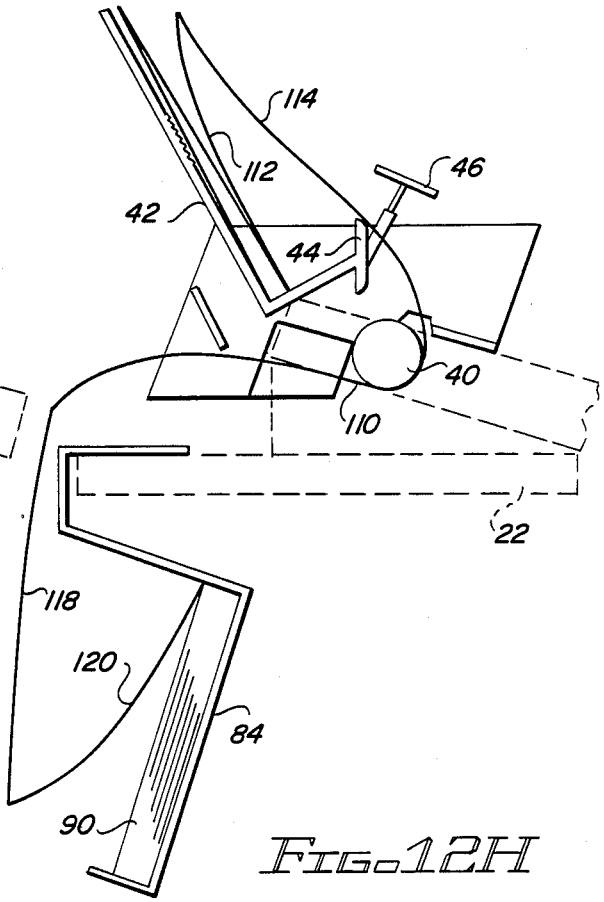
FIG. 12H

TRACTOR FEED CONTINUOUS PAPER SYSTEM FOR PRINTERS

BACKGROUND OF THE INVENTION

1. Field of the Invention

This invention relates generally to paper handling systems, and more particularly to a tractor feed continuous paper system for use in conjunction with printers.

2. Background Information

Many businesses and individuals have invested in computer systems and have purchased software for performing a number of applications such as word processing, accounting, database management, etc. Unfortunately, the printers associated with such computer systems are often operated by manually inserting single sheets of paper, checking alignment, removing finished copies, and stacking them. This technique is extremely time consuming. That is, it takes about fifteen seconds to insert and position a sheet of paper in a printer and about another twenty to thirty seconds to determine if the printing is positioned exactly where desired. Paper with special borders or logos require even more attention. Removing the finished sheets and stacking them takes additional time. In view of this, it may take over an hour to feed a printer to obtain one hundred copies.

These problems are mostly overcome and hands-off printing substantially achieved through the use of add on sheet feeders which may be of either the demand or continuous type. Demand type feeders insert the papers at the beginning of the printing operation. The printer platen or roll remains empty of paper between printing jobs. Continuous sheet feeders automatically insert the next sheet of paper at the end of the last printing operation and that sheet will remain in the printer until the next printing session.

While many tractor feed continuous paper feeders for printers are known, none have been satisfactory in all respects.

SUMMARY OF THE INVENTION

It is an object of the present invention to provide a tractor feed paper system for use in conjunction with a printer which can be adapted to work with printer stands that are either horizontal or angled with respect to the surface of the desk supporting the printer.

It is a further object of the present invention to provide an above desk continuous paper system for use in conjunction with a printer which allows an operator to view each sheet and the printing thereon as it moves from the printer.

It is a still further object of the present invention to provide a tractor feed continuous paper system for printers wherein the paper being ejected is prevented from coming into contact with the paper being drawn into the printer thereby preventing it from being pulled back into the printer.

Yet another object of the present invention is to provide an improved above desk continuous paper system capable of being adapted to all popular tractor feed printers.

It is a further object of the present invention to provide a tractor feed continuous paper system for printers which permits unattended operation as a result of its capability of redirecting and dropping the first sheet into a stacking position.

It is a still further object of the present invention to provide a paper system for use with tractor feed printers which requires no moving parts, electric connections, electronic interfacing to the computer or printer, or mechanical connection to the printer.

Yet another object of the present invention is to provide a continuous paper system for use in conjunction with a tractor feed printer which is easy to manufacture, durable, and substantially maintenance free.

It is yet a further object of the present invention to provide a continuous paper system for a tractor feed printer wherein the paper may be loaded without crawling under the desk but by merely reaching over the desk upon which the printer is mounted.

Yet another object of the present invention is to provide a continuous paper system for a tractor feed printer wherein the lower or paper storage unit is positioned at the back of the desk thereby providing for clearance of the legs and knees of operator.

A still further object of the present invention is to provide a continuous paper system for a tractor feed printer which contains the tractor feed paper so as to prevent interference with people, pets or children.

Yet another object of the present invention is to provide a continuous paper feed system for a tractor feed printer which does not protrude beyond the back of the desk which supports the printer thereby permitting placement close to walls or office traffic areas.

Yet another object of the present invention is to provide a tractor feed continuous feed paper system which stacks the tractor feed paper on its edge above and behind the printer.

According to a broad aspect of the invention there is provided a continuous paper feed system for use in conjunction with a printer positioned on a support surface, comprising a blank paper storage portion capable of being secured to a rear portion of the support surface and residing generally therebelow, and a printed paper receiving portion capable of resting on the printer, the paper receiving portion being angularly adjustable with respect to the plane of the support surface.

BRIEF DESCRIPTION OF THE DRAWINGS

The above and other objects, features and advantages of the present invention will be more clearly understood from the following detailed description taken in conjunction with the accompanying drawings, in which:

FIG. 1 is a perspective view of the inventive continuous paper system for use in conjunction with a tractor feed printer;

FIG. 2 is a perspective exploded view of the upper or receiving portion of the paper system shown in FIG. 1;

FIG. 2*a* illustrates in detail serrations or grooves which cause the first sheet to be redirected and dropped into a stacking position;

FIG. 9 is a cross sectional side view of the upper portion of the continuous paper system shown in FIG. 1;

FIG. 10 is a cross sectional view taken along line 10—10 of FIG. 9;

FIG. 11 is a front view of the upper portion of the continuous paper system shown in FIG. 9;

FIGS. 12A–12H illustrate in a step-by-step fashion how paper is drawn from the lower paper storage portion through the printer and stacked in the upper receiving portion.

DETAILED DESCRIPTION OF THE PREFERRED EMBODIMENT

Figure 3:
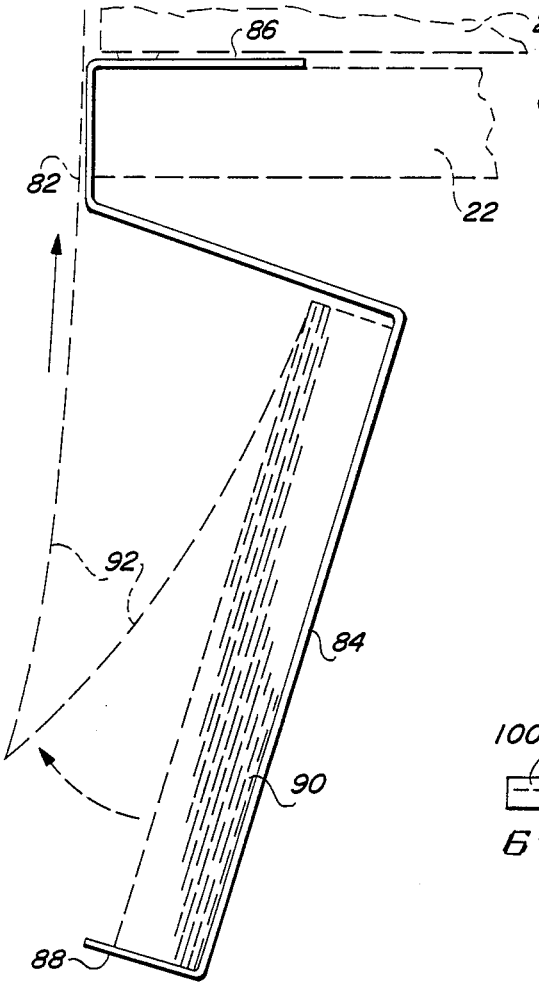
FIG. 3 is a side view of the lower or paper storage portion of the continuous paper system shown in FIG. 1.

Referring to FIG. 1, a printer designated generally as 20, is shown resting on a support surface 22 which is in turn supported by legs 24 all of which are depicted in dotted lines.

The continuous paper feed system which is the subject of the present invention comprises a blank paper storage portion designated generally 26 and a printed paper receiving portion designated generally 28. That is, blank paper 30 (shown dotted) stored in blank paper storage portion 26 passes through printer 20 and is restacked in receiving portion 28. Paper receiving portion 28 is shown in more detail in FIGS. 2, 9 and 11 wherein like reference numerals are used to denote like elements throughout the several views.

As can be seen, the paper receiving portion comprises first and second side members 32 and 34 each equipped with roller receiving openings 36 and 38 respectively. Paper receiving portion 28 simply rests on printer 20, and the rollers 40 of printer 20 are received in apertures 36 and 38 as shown in FIG. 1. Upper portion 28 also includes a receiving bin 42 to which first and second transverse guide members 44 and 46 are coupled.

Receiving bin 42 includes an upwardly inclined back section 48 and a lip 50 extending generally orthogonally from the lower edge of back portion 48. Back portion 48 is also provided with a plurality of transverse notches or grooves 52 shown in more detail in FIG. 2*a* for purposes which will be described herein-below. Transverse member 44 is coupled along its length to the outer edge of lip 50 and has an outer curved surface 54.

The space created between transverse members 44 and 46 acts as a guide for printed paper and directs the top edge of the first sheet of paper to grooves 52 in a manner to be discussed below. Since paper often comes in contact with transverse member 44, it is provided with a curved surface so as not to damage the paper and so as to permit it to glide smoothly thereover. It should thus be apparent that transverse members 44 and 46 may be coupled in a fixed space relationship as is shown in FIG. 2 by members 56. Alternately the space between transverse members 44 and 46 may be made adjustable by having transverse member 46 threadably engage transverse member 44 as is shown in FIGS. 9 and 10. That is, screws 58 pass through threaded member 46 and threadably engage internally threaded extensions 60 of transverse member 44. In this manner, screws 58 having heads 62 may be simply tightened to reduce the space between transverse members 46 and 48. This construction is shown more clearly in FIG. 10.

A transverse trap door 64 shown most clearly in FIGS. 9 and 11 is provided to provide sufficient space so as to maneuver the leading edge of the continuous paper to and through the printer. This trap door may be pivotal at pivot point 66 or in fact may be fixed in an open position.

It is well known that while some printers remain flat on the respective support surfaces others rest on stands which tilt the printer forward. Therefore, for optimum operation of the continuous feed paper system in accordance with the present invention, the entire receiving bin assembly and guide member assembly is permitted to rotate through a predetermined arc so as to enable the paper feed apparatus to be tailored to many different types of printers. This is accomplished as follows. Proximate the ends of transverse member 44 are protrusions 68 (FIG. 2) which are received by slots 70 on the inner sides of side members 32 and 34. Slots 70 each have downwardly inclined portion 72 and a substantially horizontal portion 74 where protrusions 68 finally come to rest. In this manner, the entire receiving bin and guide assembly may rotate about a point coincident with protrusions 68. A plurality of additional protrusions 76 are provided on the inner surfaces of side members 32 and 34 proximate slots 70. These protrusions frictionally engage edges 78 and 80 of back member 48 thus permitting the angular position of back 48 and therefore the remainder of the receiving bin and guide assembly to be positioned as desired with respect to the horizontal.

The blank paper storage portion is shown in more detail in FIGS. 3–8. Referring to FIG. 3, it can be seen that the blank paper storage portion is generally S-shaped and comprises a generally U-shaped support portion 82 and a U-shaped storage bin or tray 84. As can be seen, one leg 86 of support portion 82 rests on support surface 22 for the purpose of supporting tray 84 generally beneath the rear portion of the support surface. In fact, leg 86 may be further secured by positioning printer on top of leg 86 as shown.

Tray 84 is provided with a lower lip 88 extending generally orthogonally therefrom for supporting the edge of a stack of continuous paper 90. The paper may be drawn therefrom up and around the rear portion of support surface 22 and into the printer as shown by dotted lines 92 and in a fashion which will be further discussed hereinbelow.

Figure 4:
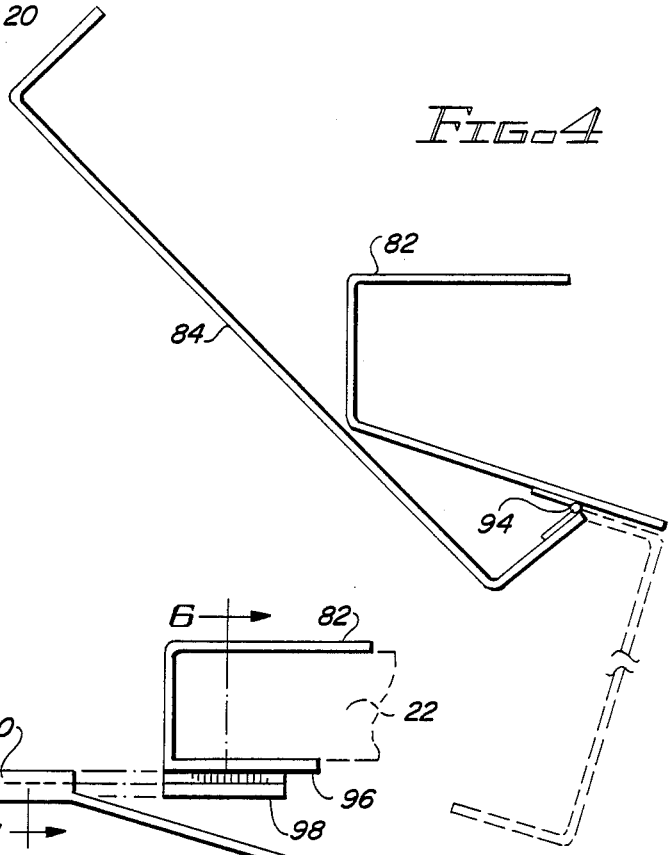
FIG. 4 illustrates an alternate embodiment of the paper storage portion.

FIG. 4 shows an alternate embodiment of the blank paper storage portion shown in FIG. 3 wherein the support portion 82 and the storage bin or tray 84 are hingeably coupled. In this manner, less space is required for shipping and storage.

Figure 5:
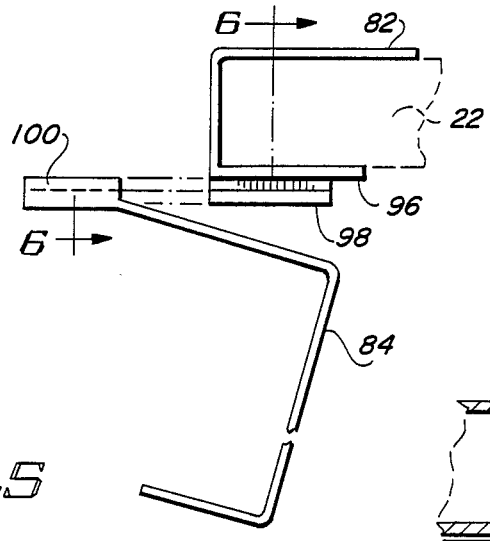
FIGS. 5 and 6 illustrate still another embodiment of the lower paper storage portion shown in FIG. 3.
Figure 6:
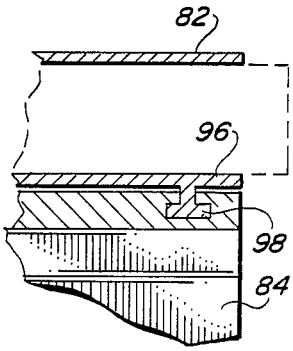

Referring to FIGS. 5 and 6, it can be seen that the support portion 82 and the storage bin 84 may in fact be separate parts. Support portion 82 is again U-shaped, and its lower leg 96 which resides beneath support surface 22 is provided with a longitudinal projection 98 in the shape of an inverted T. Bin 84 is provided with an extension 100 having a longitudinal slot therethrough also in the shape of an inverted T for slideably receiving projection 98 as is shown if FIG. 6. In this manner, bin 84 may be conveniently and easily removed from support portion 82 when desired.

Figure 7:
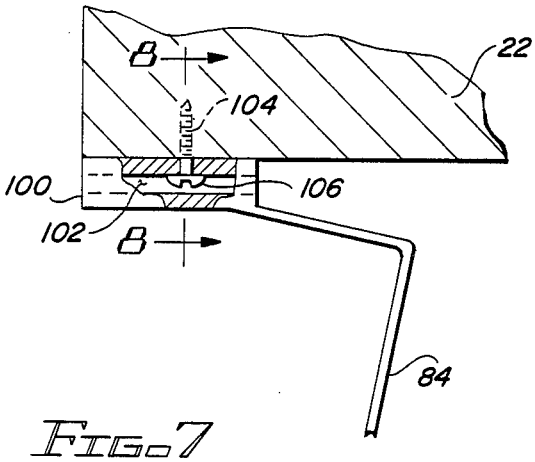
FIGS. 7 and 8 show still a further embodiment of the lower paper storage portion shown in FIG. 3.
Figure 8:
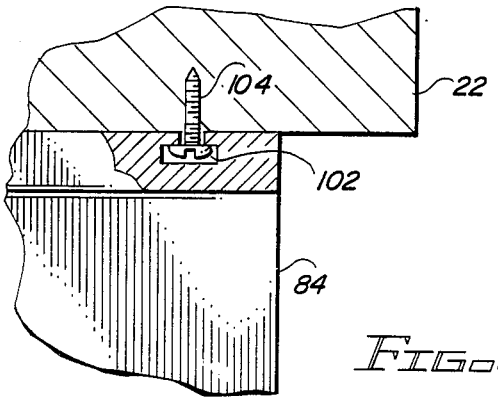

FIGS. 7 and 8 illustrate yet another mechanism for securing support bin 84 to support surface 22. Support bin 84 is identical to that shown in conjunction with FIGS. 5 and 6. That is, it is provided with an extension 100 having a longitudinal slot 102 therethrough which is in the shape of an inverted T. However in this case, slot 102 slideably engages the shank 104 and head 106 of a screw or other threaded member which threadably engages the underportion of support surface 22.

Figure 12A:
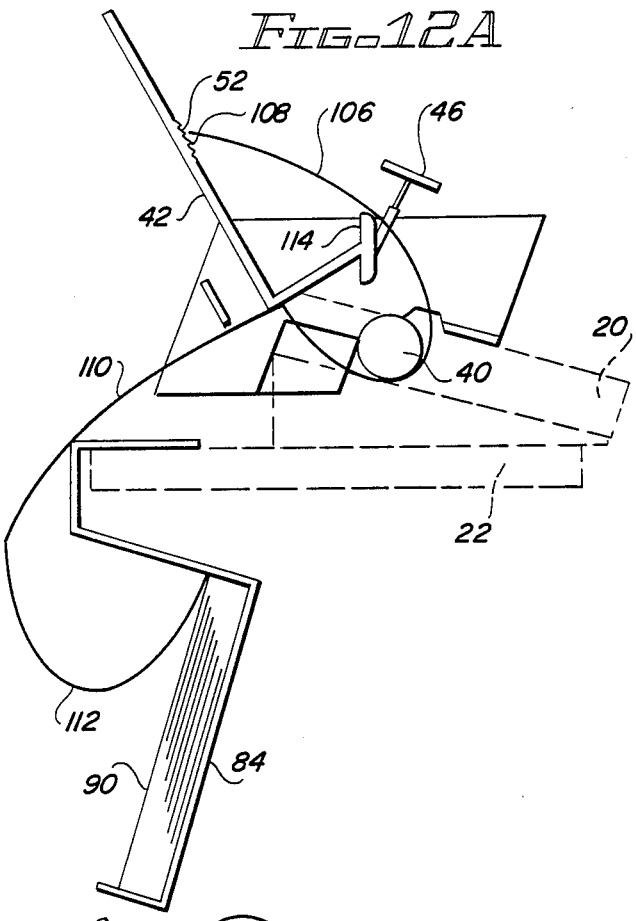
Figure 12B:
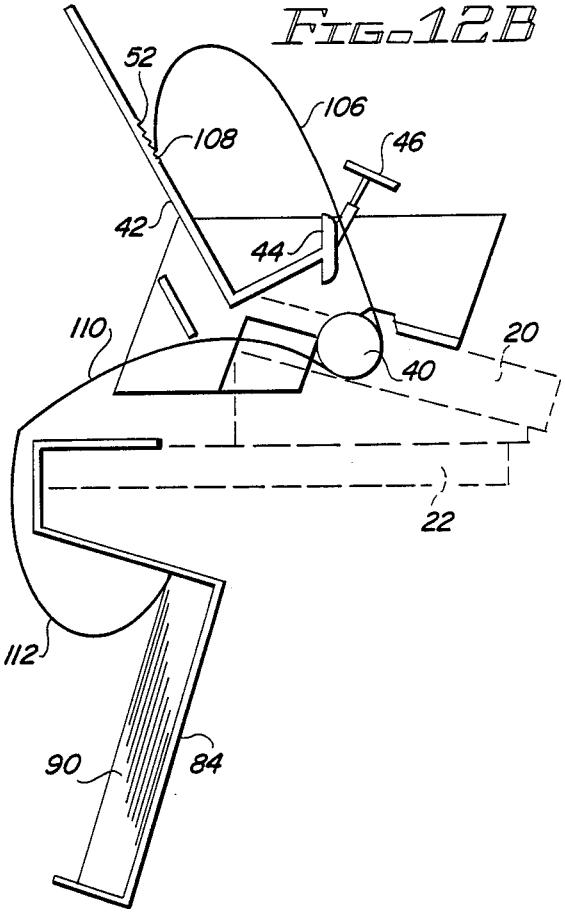
Figure 12C:
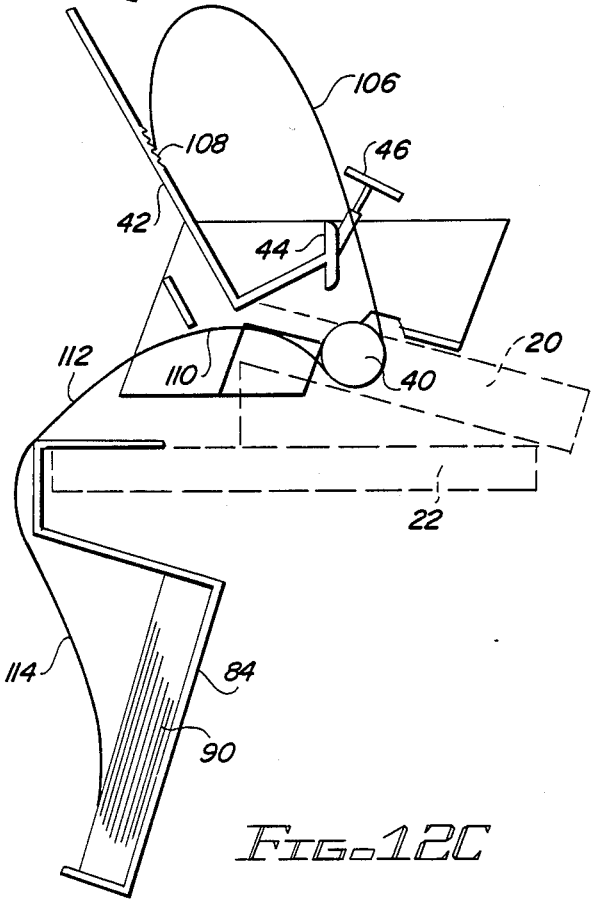
Figure 12D:
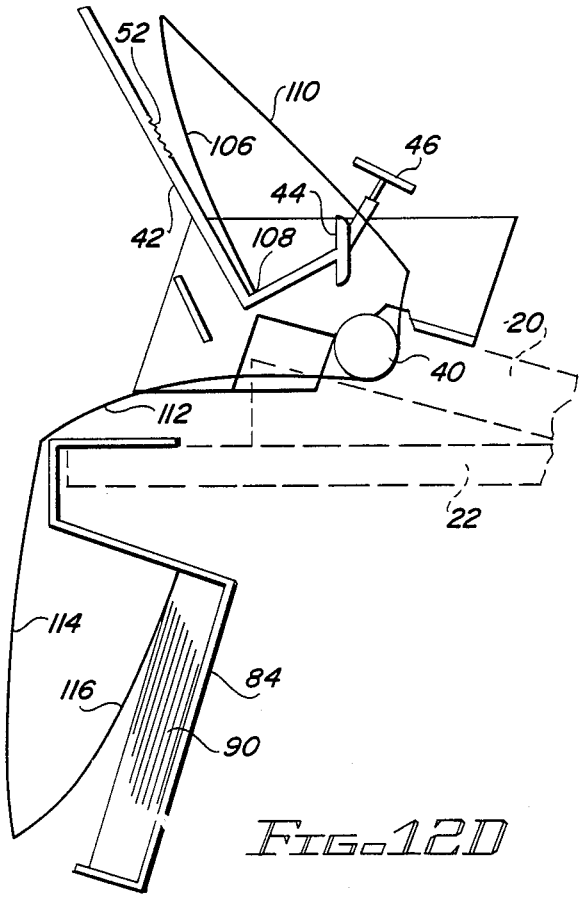

FIGS. 12A–12H illustrates the process by which paper from a continuous stack 90 is drawn from bin 84, around roller or platen 40 of printer 20, between transverse guide members 44 and 46 and into receiving bin 42. Referring to FIG. 12*a*, it can be seen that a first sheet of paper 106 having a leading edge 108 is propagating through the printer around platen 40 and between guide members 44 and 46. It is followed by sheets 110 and 112, respectively. In FIG. 12B, sheet 106 has sufficiently propagated through the printer causing leading edge 108 to engage one of the grooves 52 causing sheet 106 to curl upwards. This process is continued in FIG. 12C and it can be seen that an additional sheet 114 is pulled from stack 90. In FIG. 12D, sheet 106 has curled sufficiently such that leading edge 108 disengages from groove 52 and falls to the lower part of the storage bin. An additional sheet 116 has been pulled from stack 90. This process continues in FIG. 12E until, as shown in FIG. 12F, sheet 110 resides substantially on top of sheet 106. Figs. 12G and 12H illustrate how the process continues which each successive sheet laying to rest on the former sheet in bin 42.

Figure 13A:
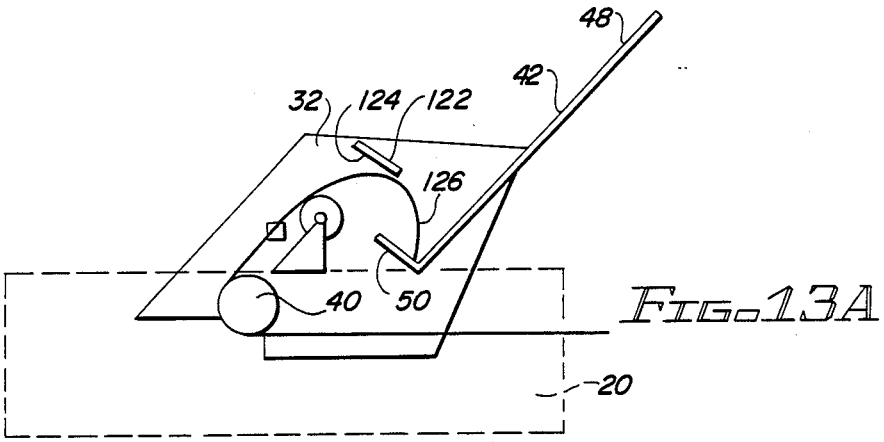
FIGS. 13A–13B illustrate an alternate embodiment of the upper or receiving portion of the inventive paper system.
Figure 13B:
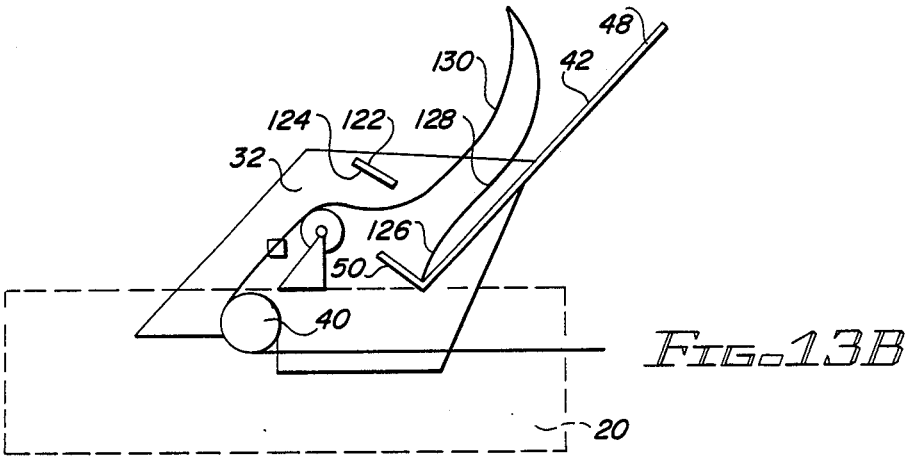

FIGS. 13A and 13B are side views of an alternative embodiment of the printed paper receiving portion. Again, like elements are denoted with like reference numerals. It can be seen that in this case only a single transverse guide member 122 is coupled between side members 32 and 34 (only 32 is shown). By properly angularly positioning deflection surface 124 of guide member 122, the leading edge of the paper 126 is directed to the junction of back 48 and lip 50. That is, this junction now takes the place of grooves 52. The first sheet of paper 128 will then be received and rest upon back 48 with leading edge 126 at the bottom. Subsequent sheet 130 will then come to rest on sheet 128 as is shown if FIG. 13B.

Thus there has been provided an above desk continuous paper system which may be adapted to almost any tractor feed paper printer. The paper holder for fresh paper sits under and behind the desk top upon which the printer rests and the paper catcher or receiving bin sits atop the printer and behind the printer's platen. This system contains no moving parts nor any electrical connections. Paper exiting the printer does not contact paper being fed into the printer thereby substantially reducing the possibility of jamming. The operator can view each page as it is being printed. This system is easily manufactured as for example by plastic injection molding and may be an add-on to an existing printer or formed integrally with the printer itself. The receiving bin for printer paper may be angularly adjustable to accommodate tilted printing stands as paper will stack in the receiving tray when it is oriented between 105° and 180° with the horizontal.

The above description is given by way of example only. Changes in form and detail may be made by one skilled in the art without departing from the scope of the invention as defined by the appended claims.

I claim:

1. A continuous paper feed system for use in conjunction with a printer positioned on a support surface, comprising:

a blank paper storage portion capable of being secured to a rear portion of said support surface and residing generally therebelow; and a printed paper receiving portion capable of resting on said printer, said paper receiving portion being angularly adjustable with respect to the plane of said surface, said receiving portion comprising:

first and second side members capable of being positioned on first and second sides of said printer;

a receiving bin pivotally coupled between said first and second side members, said receiving bin including an upwardly inclined back portion having a front surface and upper and lower edges, and a lip coupled to said lower edge and extending substantially orthogonally therefrom; and guide means coupled to opposite ends of said receiving bin for directing paper exiting said printer to said receiving bin, said front surface including a plurality of transverse grooves intermediate said upper and lower edges for engaging an upper edge of the paper and directing it to said lip.

2. A system according to claim 1, wherein said guide means comprises:

a first transverse member coupled to an outer edge of said lip; and a second transverse member coupled in spaced relationship with said first transverse member defining a space therebetween through which paper passes.

3. A system according to claim 2, further comprising first means for varying the distance between said first and second transverse members.

4. A system according to claim 3, wherein said first and second side members are provided with a plurality of protrusions which frictionally engage said receiving bin so as to allow it to be angularly adjustable with respect to the plane of said surface.

5. A system according to claim 4, wherein said first transverse member is provided with a curved surface over which said paper may glide.

6. A system according to claim 5, further comprising:

first and second protrusions at each end respectively of said guide means; and first and second cavities in said first and second side members respectively for receiving said first and second protrusions so as to enable rotation of said paper receiving portion.

7. A system according to claim 3, wherein said first means comprises first and second threaded members for threadably engaging said first and second transverse members.

8. A system according to claim 1, wherein said blank paper storage portion comprises:

support means for engagement with said support surface; and a storage bin for coupling to said support means and residing generally below said support surface.

9. A system according to claim 8, wherein said support means comprises a generally U-shaped support portion having a first leg portion residing on said surface, a second leg portion residing generally below said surface and a connecting portion for connecting said first and second leg portions.

10. A system according to claim 9, wherein said storage bin is pivotally coupled to said support means.

11. A system according to claim 10, wherein said support bin is pivotally coupled to said second leg portion.

12. A system according to claim 9, wherein said storage bin is slideably coupled to said support means.

13. A system according to claim 12, wherein said support means is provided with at least one longitudinal protrusion which slideably engages a longitudinal slot in said storage bin.

14. A system according to claim 8, wherein said storage means comprises at least one threaded member having a shank and a wider head in which may be partially screwed into an underside of said surface.

15. A system according to claim 14, wherein said storage bin has at least one slot therein which slideably engages the shank and head of said threaded member.

* * * * *